US006833535B2

(12) United States Patent
Streit et al.

(10) Patent No.: US 6,833,535 B2
(45) Date of Patent: Dec. 21, 2004

(54) METHOD AND CONTROL STRUCTURE FOR A SENSOR HEATER

(75) Inventors: James W. Streit, Cortland, OH (US); Dale M. Harris, Boardman, OH (US)

(73) Assignee: Delphi Technologies, Inc., Troy, MI (US)

( * ) Notice: Subject to any disclaimer, the term of this patent is extended or adjusted under 35 U.S.C. 154(b) by 21 days.

(21) Appl. No.: 10/377,424

(22) Filed: Feb. 28, 2003

(65) Prior Publication Data

US 2004/0170212 A1 Sep. 2, 2004

(51) Int. Cl.[7] ..... H05B 1/02

(52) U.S. Cl. ..... 219/492; 219/501; 219/497; 323/322; 307/130

(58) Field of Search ..... 219/492, 494, 219/497, 499, 501, 505, 490; 307/130, 117; 323/322, 364

(56) References Cited

U.S. PATENT DOCUMENTS 4,763,564 A 8/1988 Czarnecki et al.
4,920,823 A 5/1990 Mohr et al.
5,260,548 A * 11/1993 Todd et al. ..... 219/483
5,954,577 A 9/1999 Meckler
6,055,848 A 5/2000 Weigold
6,206,775 B1 3/2001 Lemaitre et al.
6,298,291 B1 10/2001 Davis, Jr. et al.
6,314,789 B1 11/2001 Peter
6,422,062 B1 7/2002 King et al.
6,508,117 B1 1/2003 DuBois et al.
2002/0179443 A1 * 12/2002 Hada et al. ..... 204/408

* cited by examiner

*Primary Examiner*—Mark Paschall
(74) *Attorney, Agent, or Firm*—David P. Wood

(57) ABSTRACT

A control structure and method for controlling a sensor heater including a power supply connected to a switching device for pulse width modulating a voltage from the power supply. The switching device is further connected to a resistance heater. A microcontroller having a single output is connected to the switching device and a single input from the microcontroller is connected to a high side of the resistance heater. The microcontroller determines a pulse width modulation duty cycle to maintain a constant power dissipation of the resistance heater.

9 Claims, 2 Drawing Sheets

METHOD AND CONTROL STRUCTURE FOR A SENSOR HEATER

FIELD OF THE INVENTION

This invention relates to a method and structure of controlling a sensor heater, and with more particularity to a method and structure of controlling a sensor heater using a pulse width modulation duty cycle.

BACKGROUND OF THE INVENTION

Various types of sensors are heavily dependent on operating temperature, dictating the quality of the response value detected by the sensor. Included in this class of sensors are: pollution sensors, combustible gas sensors, organic solvent sensors, toxic gas sensors, VOC sensors, as well as other sensors known in the art. Therefore, manufacturers of these types of sensors generally include heater elements associated with the sensors so that they operate at elevated temperatures, sometimes in the range of greater than 400° C. to maintain a quality of a response signal. Heaters associated with these types of sensors generally consume a constant power such that they can dissipate a constant amount of heat. If the heaters do not consume a constant power, a sensor response may be inaccurate. Various manufacturers of sensors recommend that the heaters be powered by a specific constant direct current voltage to maintain an accurate and constant power dissipation.

Sensors currently utilized in the art have problems dissipating the heat created through the operation of the sensor. Heat is generated from both the heater, as well as the power supply electronics necessary for operating the sensor. The power supply electronics convert a power supply voltage to a specific voltage needed to drive a sensor's heater. In typical automotive applications for example, a power supply voltage can range from 9 to 16 volts, while a sensor heater voltage must be stepped down to operate at a lower voltage usually in the range of from 5 to 7 volts. However, in various commercial applications, power supply voltages can be increased in the range of up to 24 volts. Therefore, the heat that must be dissipated to maintain a constant operating temperature of a sensor in such situations is large.

It is known in the art that linear regulators may be utilized to supply a constant voltage to a device that is lower than the supply voltage by dissipating power through a linear regulator such that the energy is dispersed in the form of heat. When utilizing such a method, often a large expensive heat sink may be utilized to dispense the heat. Such expensive heat sinks occupy a significant amount of space, as well as contribute to an overall cost of a sensor.

One method of solving the above problem of dissipating heat is by pulse width modulating (PWM) the voltage which powers a sensor heater. Pulse width modulation is a method of turning a load on and off very quickly through a switching device. Typically, a full supply voltage is switched off and on at a specific duty cycle less than 100 percent. As the voltage is switched on and off, the same amount of power is delivered to the load, but less power is consumed by the switching device than by a linear regulator, as referenced above. A heater associated with a sensor must dissipate a constant amount of heat to maintain the temperature and therefore the accuracy of the sensor. The power dissipated through the heater is generally a function of a voltage passed through the heater element, as well as the current running through it. One problem typically associated with a PWM circuit is that the current running through the heater must be known. It is often difficult to measure current directly and cost-effectively in an electronic circuit. Therefore, indirect methods are used to measure a current. For example, a known pulse width modulation circuit for a sensor utilizes a low resistance value, high wattage tight tolerance resistor that is placed in series with a heater associated with the sensor. The voltage across the sense resistor is measured utilizing an analog to digital converter on a microcontroller. Another analog to digital converter measures a voltage provided to the heater. Therefore, in order to calculate a current running through the heater, the voltage is measured on each side of the sense resistor using the analog to digital converters and the difference is divided by the sense resistor's known resistance value. While this arrangement provides a method of pulse width modulating a heater for a sensor, the control circuit is complex and requires three input/output lines of a microcontroller. Typically, one input and output is used to determine the system voltage, another is needed to provide a feedback voltage, and a third is utilized to control a switch or relay to pulse width modulate the voltage for the heater based on the previous inputs.

There is, therefore, a need in the art for a control structure for a sensor heater, as well as a method of controlling the sensor heater without the use of expensive heat sinks and large microcontrollers, as well as provides a reliable means of controlling a power dissipation of a sensor heater.

SUMMARY OF THE INVENTION

A control structure for a sensor heater including a power supply connected to a switching device for pulse width modulating a voltage from the power supply. The switching device is further connected to a resistance heater associated with a sensor. A microcontroller having a single output is connected to the switching device. A single input of a microcontroller is connected to a high side of the resistance heater. The microcontroller determines a pulse width modulation duty cycle to maintain a constant power dissipation of the resistance heater. This is done without the need to measure/calculate the current.

Also, disclosed is a method of controlling a sensor heater including the steps of (a) providing a microcontroller for adjusting a pulse width modulation duty cycle of a heater, (b) measuring a peak voltage at the high side of a resistance heater, (c) determining a pulse width modulation duty cycle according to the equation: duty cycle=Ton/Tcycle which= $Vrms^2/Vpeak^2$ where Ton is the time of the duty cycle when voltage is being transmitted to a heater and Tcycle is the total time of a duty cycle, and Vrms is a constant desired voltage and Vpeak is a voltage that is measured on a high side of the resistance heater, (d) transmitting the pulse width modulation duty cycle to the heater to maintain a constant power dissipation of the heater.

DETAILED DESCRIPTION OF THE PREFERRED EMBODIMENTS

Figure 1:
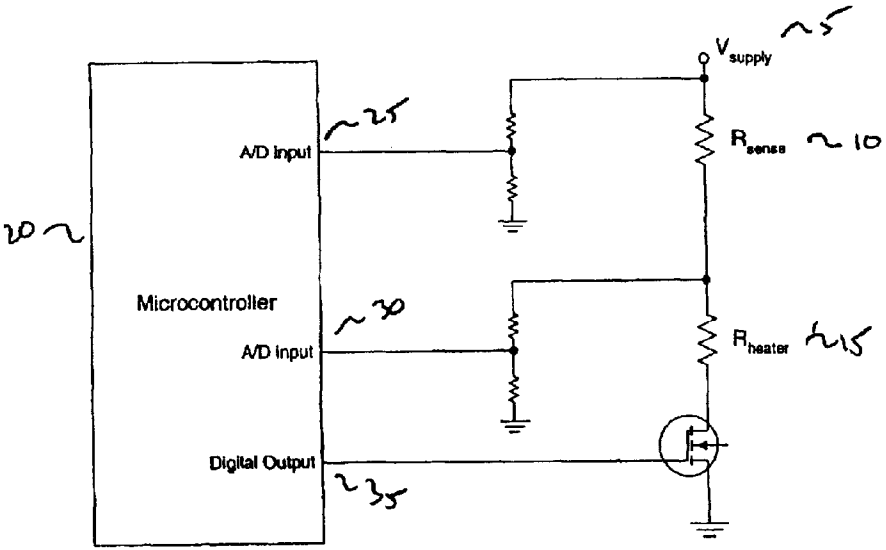
FIG. 1 is a schematic of a prior art pulse width modulation circuit for a sensor heater.

FIG. 1 illustrates a prior art schematic of a pulse width modulation circuit for use in a sensor heater application. A voltage supply 5 is connected to a sense resistor 10 in series with a resistance heater 15. A microcontroller 20 includes a first A/D input 25 utilized to measure a voltage from the power supply 5. A second A/D input 30 of the microcontroller 20 measures the voltage on the low side of the sense resistor 10 which coupled with the voltage measured in the first A/D input 25 is utilized to calculate a current through the resistance heater 15. The microcontroller 20 calculates an appropriate pulse width modulation signal and sends it through the digital output 35 to generate a pulse width modulation signal for the voltage power supply 5. As can be seen, three input/output ports 25, 30, 35 are required on a microcontroller 20 to operate the feedback loop.

Figure 2:
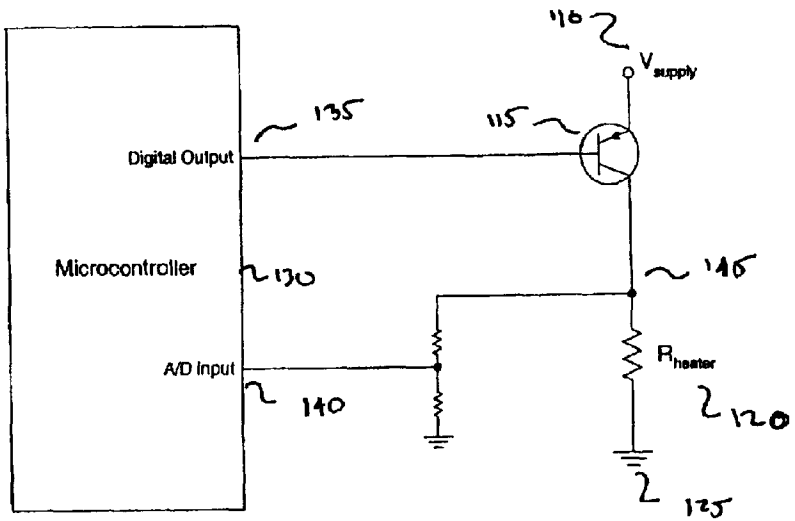
FIG. 2 is a schematic of a pulse width modulation circuit according to the present invention.

With reference to FIG. 2, there is shown a control structure 105 for a sensor heater of the present invention. As can be seen, a power supply 110 is connected to a switching device 115 for pulse width modulating a voltage from the power supply 110. The switching device 115 is further connected to a resistance heater 120 and then to a ground 125. A microcontroller 130 having a single output 135 is connected to the switching device 115. A single input 140 from the microcontroller 130 is connected to a high side 145 of the resistance heater 120 for measuring a peak voltage. The microcontroller 130 calculates a pulse width modulation duty cycle to maintain a constant power dissipation of the resistance heater 120. In a preferred aspect of the present invention, the switching device 115 is selected from the group consisting of: field effect transistors, bipolar junction transistors, metal oxide semiconductor field effect transistors, and relays.

As can be seen in FIG. 2, the schematic includes a single output 135 and a single input 140 for the microcontroller 130, as opposed to the three input or outputs 25, 30, 35 required in the prior art embodiment. Also, the sense resistor 10 of the first embodiment is not required in the schematic of the present invention shown in FIG. 2. In this manner, a significant cost savings can be achieved with respect to a pulse width modulation of a supply voltage 1 10 for a resistor heater 120 associated with a sensor.

Also, disclosed is a method of controlling a sensor heater that includes the steps of: providing a microcontroller 130 as shown in FIG. 2 for adjusting a pulse width modulation duty cycle of a resistance heater 120. A peak voltage is measured across the resistance heater 120 as indicated by the single input 140 of FIG. 2. A pulse width modulation duty cycle is then calculated according to the equation:

duty cycle=Ton/Tcycle which=$Vrms^2/Vpeak^2$ wherein Ton is the time of the duty cycle when voltage is being transmitted to a heater and Tcycle is the total time of the duty cycle, Vrms is a constant desired voltage used by the heater and Vpeak is a voltage that is measured on the high side of the resistance heater.

The pulse width modulation duty cycle is then transmitted through the single output 135 to the resistance heater 120 such that a constant power dissipation of the heater 120 is maintained. As referenced above, the peak voltage is measured only when the voltage is being transmitted to the heater 120 corresponding to the Ton portion of the duty cycle. In this manner, an accurate reading of the actual peak voltage is utilized rather than a filtered or average value obtained through a RC filter or other feedback device.

Figure 3:
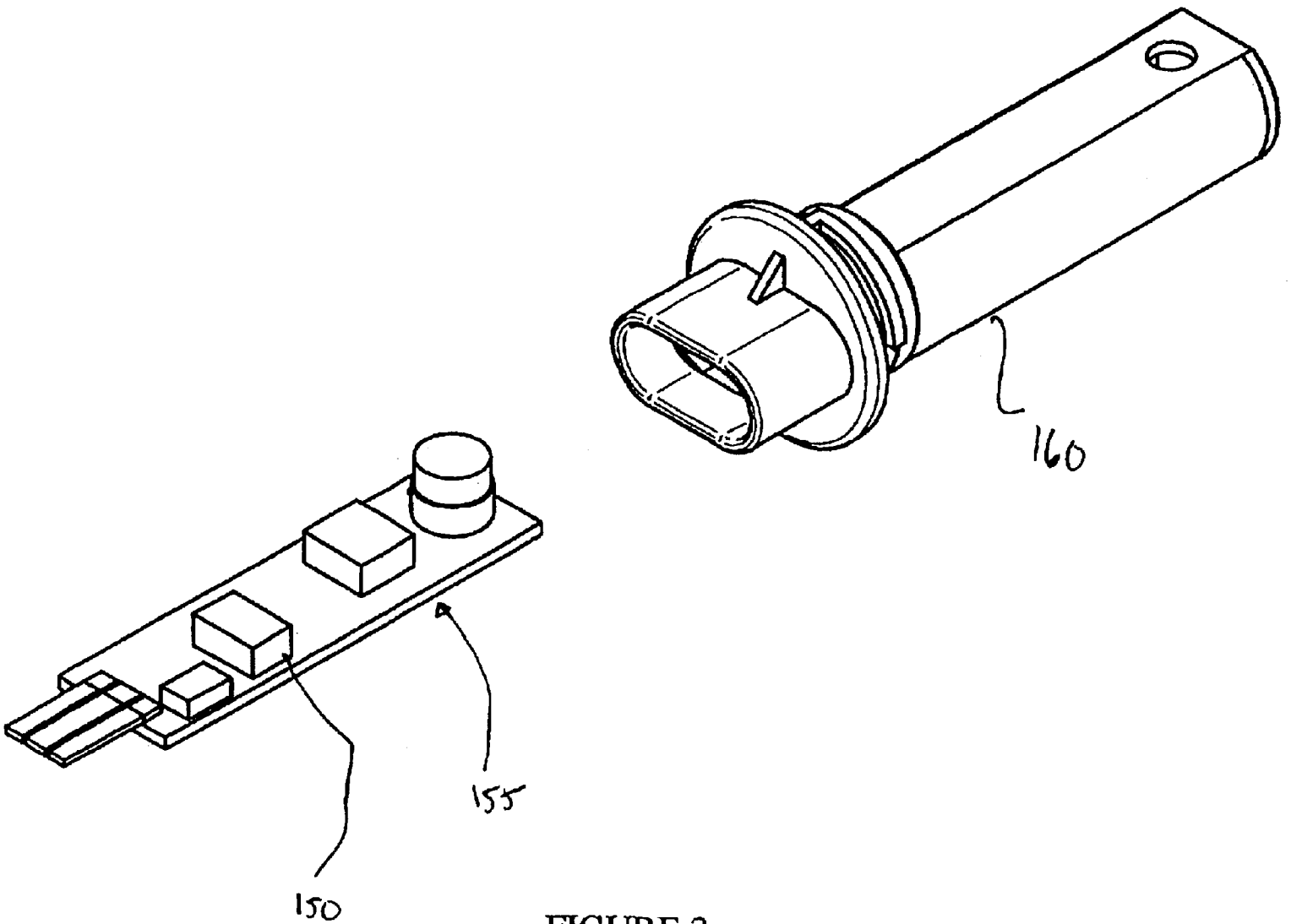
FIG. 3 is a perspective view of a sealed air quality sensor that is inserted inside a sealed connector to maintain contact of the sensor with an air flow within a duct.

With reference to FIG. 3, there is shown a preferred embodiment of an air quality sensor 150 having a control structure 105 of the present invention. As can be seen, the sensor and heater electronics 155 are inserted inside a sealed connector 160 that includes opposing vents and filter membranes (not shown) to maintain a flow of duct air through an air quality control system without the introduction of outside air or foreign debris. In this manner, the air quality sensor 150 measures a controlled air flow for a faster response time to changes in air quality.

A specific example of a preferred embodiment comparing the control structure and method of the present invention with a linear regulator will be exemplified to show the relative power dissipations necessary for maintaining an accurate sensor reading. A 16 volt power supply is connected to a 7 volt linear regulator which is in turn connected to an 86 ohm resistance heater. The current passing across the heater is calculated by dividing the voltage supplied to the heater, 7 volts after passing through the linear regulator, divided by the 86 Ohm resistance giving a current of 81.4 mAmps. The power dissipation through the linear regulator is calculated by multiplying the voltage times the current or the difference between 16 volts and the 7 volt output of the linear regulator times 81.4 mAmps giving 733 mW of power dissipation. The power dissipation through the heater is likewise calculated by multiplying the voltage, 7 volts by the current 81.4 mAmps giving 570 mW of power dissipation. Therefore, the total power dissipated equals the 733 mW of power through the linear regulator added to the 570 mW through the heater giving a total of 1,303 mW of power dissipation.

In comparison with the control structure and method of the present invention, again assuming a supply voltage of 16 volts and a switching transistor having a saturation voltage of 0.5 volts, resulting in a peak voltage measured on a high side of a resistor of 15.5 volts. Again the resistor heater has an 86 Ohm resistance. The current passing through the system can be calculated by dividing the voltage of the heater by the resistance of the heater or 15.5 volts divided by 86 Ohms giving a current of 180.2 mAmps. A duty cycle may be calculated by dividing the square of the desired voltage of 7 volts by the square of the peak voltage of 15.5 volts thereby giving a duty cycle of 0.204 or 20.4 percent. The power dissipation through the switching transistor may be calculated by multiplying the saturation voltage of the transistor 0.5 volts by the current of 180.2 mAmps multiplied by the duty cycle of 20.4 percent giving a total power dissipation of 18.4 mW through the switching transistor. The power dissipation through the heater is again calculated in the same manner as the previous example by multiplying the voltage of the heater, 15.5 volts, by the current, 180.2 mAmps, multiplied by the duty cycle of 20.4 percent yielding a power dissipation of 570 mW. The total power dissipated is therefore the sum of the power dissipated through the switching transistor of 18.4 mW plus the 570 mW dissipated through the heater yielding a total of 588.4 mW. As can be seen from the above example, the total heat dissipated by the structure and method of the present invention is significantly less than that of a linear regulator.

While preferred embodiments are disclosed, a worker in this art would understand that various modifications would come within the scope of the invention. Thus, the following claim should be studied to determine the scope and content of the invention.

What is claimed is:

1. A method of controlling a sensor heater comprising the steps of:

a) providing a microcontroller for adjusting a pulse width modulation duty cycle of a heater;

b) measuring a peak voltage across the heater;

c) determining a pulse width modulation duty cycle according to the equation:

duty cycle=Ton/Tcycle=$Vrms^2/Vpeak^2$ where Ton is the time of the duty cycle when voltage is being transmitted to a heater and Tcycle is the total time of the duty cycle, end Vrms is a constant desired voltage and Vpeak is a voltage that is measured on the high side of the heater;

d) transmitting the pulse width modulation duty cycle to the heater for maintaining a constant power dissipation of the heater.

2. The method of controlling a sensor heater of claim 1 wherein the micro-controller utilizes a single input for calculating the pulse width modulation duty cycle.

3. The method of controlling a sensor heater of claim 1 wherein the micro-controller utilizes a single output for transmitting the pulse-width modulation duty cycle to the heater.

4. The method of controlling a sensor heater of claim 1 wherein the peak voltage is measured when voltage is being transmitted to the heater corresponding to the Ton portion of the duty cycle.

5. A control structure for a sensor heater comprising:

a power supply connected to a switching device for pulse width modulating a voltage from the power supply, the switching device further connected to a resistance heater that is associated with a sensor;

a microcontroller having a single output connected to the switching device and a single input connected to a high side of the resistance heater, the microcontroller determining a pulse width modulation duty cycle to maintain a constant power dissipation of the resistance heater.

6. The control structure of claim 5 wherein the single input comprises a peak voltage measured on the high side of the resistance heater when a voltage is transmitted to the heater.

7. The control structure of claim 5 wherein the single output comprises a pulse width modulation duty cycle.

8. The control structure of claim 5 wherein the switching device comprises a switch selected form the group consisting of: field effect transistors, bipolar junction transistors, metal oxide semiconductor field effect transistors, and relays.

9. A control structure for a sensor heater comprising:

a power supply connected to a switching device for pulse width modulating a voltage from the power supply, the switching device further connected to a resistance heater;

a microcontroller having a single output connected to the switching device and a single input connected to a high side of the resistance heater, the microcontroller determining a pulse width modulation duty cycle to maintain a constant power dissipation of the resistance heater;

wherein the pulse width modulation duty cycle is determined according to the equation:

duty cycle=Ton/Tcycle=$Vrms^2/Vpeak^2$ where Ton is the time of the duty cycle when voltage is being transmitted to a heater and Tcycle is the remainder of the total time of the duty cycle, and Vrms is a constant desired voltage and Vpeak is a voltage that is measured on the high side of the heater.

* * * * *